US010082150B2

(12) United States Patent
Rutter et al.

(10) Patent No.: US 10,082,150 B2
(45) Date of Patent: Sep. 25, 2018

(54) SEAL SECTION WITH INTERNAL LUBRICANT PUMP FOR ELECTRICAL SUBMERSIBLE WELL PUMP

(71) Applicant: Baker Hughes Incorporated, Houston, TX (US)

(72) Inventors: Risa Rutter, Claremore, OK (US); Arturo Luis Poretti, Claremore, OK (US)

(73) Assignee: Baker Hughes, a GE Company, LLC, Houston, TX (US)

( * ) Notice: Subject to any disclaimer, the term of this patent is extended or adjusted under 35 U.S.C. 154(b) by 244 days.

(21) Appl. No.: 15/130,112

(22) Filed: Apr. 15, 2016

(65) Prior Publication Data

US 2017/0037861 A1 Feb. 9, 2017

Related U.S. Application Data

(60) Provisional application No. 62/201,982, filed on Aug. 6, 2015.

(51) Int. Cl.

| | |
|---|---|
| ***E21B 43/12*** | (2006.01) |
| ***F04D 29/08*** | (2006.01) |
| ***F04D 29/06*** | (2006.01) |
| ***F04D 29/043*** | (2006.01) |
| ***F04D 3/02*** | (2006.01) |

(Continued)

(52) U.S. Cl.

CPC ..... *F04D 29/086* (2013.01); *E21B 43/128* (2013.01); *F04D 3/02* (2013.01); *F04D 13/10* (2013.01); *F04D 13/12* (2013.01); *F04D 13/16* (2013.01); *F04D 29/043* (2013.01); *F04D 29/061* (2013.01); *F04D 29/102* (2013.01)

(58) Field of Classification Search

CPC ..... E21B 43/128

See application file for complete search history.

(56) References Cited

U.S. PATENT DOCUMENTS

| | | | |
|---|---|---|---|
| 5,622,222 | A | 4/1997 | Wilson et al. |
| 6,851,935 | B2 | 2/2005 | Merrill |

(Continued)

OTHER PUBLICATIONS

U.S. Appl. No. 14/682,569, filed Apr. 9, 2015—inventors: David Tanner, Aroo Meyer and Ryan Semple—entitled: "Metal Bellows Seal Section and Method to Evacuate Air During Filling".

(Continued)

*Primary Examiner* — Robert Edward Fuller

(74) *Attorney, Agent, or Firm* — Bracewell LLP; James E. Bradley

(57) ABSTRACT

A well pump assembly has a submersible well fluid pump, motor, and seal section with a seal section shaft for transferring rotation of a motor drive shaft to a pump drive shaft. The seal section has a shaft passage through which the seal section shaft extends. A movable compensating element has an interior containing motor lubricant that is in fluid communication with motor lubricant in the motor and also in fluid communication with motor lubricant in the shaft passage. A shaft seal restricts well fluid from entry into the shaft passage. A lubricant pump driven by the shaft has a discharge within the shaft passage below the shaft seal. A recirculation passage extends from the shaft passage at a point between the discharge of the lubricant pump and the shaft seal to the interior of the compensating element.

13 Claims, 4 Drawing Sheets

(51) Int. Cl.

| | |
|---|---|
| ***F04D 13/10*** | (2006.01) |
| ***F04D 13/12*** | (2006.01) |
| ***F04D 13/16*** | (2006.01) |
| ***F04D 29/10*** | (2006.01) |

(56) References Cited

U.S. PATENT DOCUMENTS

| | | | | |
|---|---|---|---|---|
| 7,520,735 | B2 | 4/2009 | Merrill | |
| 7,530,391 | B2 | 5/2009 | Hall | |
| 7,665,975 | B2 | 2/2010 | Parmeter | |
| 8,221,092 | B2 | 7/2012 | Chilcoat | |
| 2003/0123764 | A1 | 7/2003 | Kull et al. | |
| 2007/0140876 | A1 | 6/2007 | Parmeter et al. | |
| 2009/0022609 | A1 * | 1/2009 | Pyatov ..... | F04D 13/083 417/423.3 |
| 2011/0236233 | A1 | 9/2011 | Merill | |
| 2012/0257985 | A1 | 10/2012 | Parmeter et al. | |
| 2015/0023805 | A1 | 1/2015 | Pyron | |

OTHER PUBLICATIONS

U.S. Appl. No. 14/690,041, filed Apr. 17, 2015—inventors: David Tanner, Aron Meyer, Arturo Poretti and Ryan Semple—entitled: "Below Motor Equalizer of Electrical submersible Pump and Method for Connecting".

Nov. 7, 2016 International Search Report and Written Opinion of related PCT/US2016/045413.

* cited by examiner

SEAL SECTION WITH INTERNAL LUBRICANT PUMP FOR ELECTRICAL SUBMERSIBLE WELL PUMP

CROSS REFERENCE TO RELATED APPLICATION

This application claims priority to provisional application 62/201,982, filed Aug. 6, 2015.

FIELD OF THE DISCLOSURE

This disclosure relates in general to hydrocarbon well pumps and in particular to a seal section that has a movable compensator element for reducing a pressure difference between lubricant in the motor and well fluid, the seal section also having an internal lubricant pump to pressurize the lubricant in the seal section slightly above hydrostatic well fluid pressure.

BACKGROUND

One type of pump assembly used particularly in oil producing wells has a submersible pump driven electrical motor filled with a dielectric motor lubricant. The motor rotates a shaft assembly to drive the pump. A seal section connects between the motor and the pump. The seal section has a pressure equalizing element that reduces a pressure differential between lubricant into the motor and well fluid on the exterior. The pressure equalizing element is typically an elastomeric, flexible bag or a metal bellows. Motor lubricant in communication with motor lubricant in the motor fills the interior of the pressure equalizing element. A well fluid communication port admits well fluid into the seal section on the exterior of the pressure equalizing element.

A shaft seal, which is normally a mechanical face seal, seals well fluid from entry into the pressure equalizing element. The shaft seal includes a rotating element or runner that rotates with the shaft. An elastomeric boot and spring urge the seal runner against a stationary base. Slight leakage occurs at the interface between the seal runner and seal base for lubrication.

The pressure equalizing element flexes to equalize the lubricant pressure in the bag with well fluid pressure on the exterior of the seal section. If the pressure differential at the interface between the seal runner and the seal base is equal to or nearly zero, there is no control on the direction of leakage at the interface between the seal runner and seal base. A zero pressure differential not only allows the well fluid to leak inside the pressure equalizing element, it can also cause overheating between the seal runner and seal base due to the lack of lubrication and cooling. Generally, mechanical face seals ran more stable and last longer when there is a small amount of differential pressure at the interface.

Prior art seal sections may have a check valve that allows some of the lubricant in the pressure equalizing element to expel due to thermal expansion of the lubricant. However, the check valve normally retains a differential pressure of the lubricant pressure above the well fluid pressure only when the lubricant in the pressure equalizing element is at a maximum expansion. Daring operation over a long period of time, the lubricant will typically diminish in volume.

SUMMARY

A well pump assembly includes a well fluid pump, a motor, and a seal section between the motor and the well fluid pump. The seal section has a shaft for transferring rotation of a motor drive shaft to a pump drive shaft. The seal section has a housing having at least one guide member with a shaft passage through which the seal section shaft extends. The guide member defining a chamber within the housing. A compensating element has an upper end in sealing engagement with the guide member around the shaft passage and an interior in fluid communication with lubricant in the motor. A seal seals around the shaft at the shaft passage for sealing well fluid from entry into the compensating element. A well fluid pressure port in the seal section applies well fluid pressure to the exterior of the compensating element.

A lubricant pump is located within the shaft passage below the seal. The lubricant pump is in fluid communication with the lubricant in the compensating element and driven by the seal section shaft for applying a pressure to an annular space between the lubricant pump and the seal that is greater than the well fluid pressure on the exterior of the compensating element.

A recirculation port extends within the guide member from the annular space to the interior of the compensating element to recirculate lubricant discharged by the lubricant pump. A labyrinth tube may be secured to the outlet of the recirculation port. The labyrinth tube extends downward within the compensating element to a lower portion of the compensating element to discharge the lubricant being pumped by the lubricant pump.

A vent passage extends from the annular space through the guide member to an ulterior of the housing on the exterior of the compensating element. A check valve allows venting of lubricant through the vent passage if the lubricant pressure exceeds the well fluid pressure by a selected amount. The lubricant pump operates at an output pressure less than the selected amount of the check valve.

The lubricant pump has a least one helical flow channel. In one embodiment, the lubricant pump comprises a sleeve that rotates with the shaft and has at least one external helical flow channel. In another embodiment, the lubricant pump comprises a non-rotating sleeve with at least one internal helical flow channel.

BRIEF DESCRIPTION OF THE DRAWINGS

So that the manner in which the features, advantages and objects of the disclosure, as well as others which will become apparent, are attained and can be understood in more detail, more particular description of the disclosure briefly summarized above may be had by reference to the embodiment thereof which is illustrated in the appended drawings, which drawings form a part of this specification. It is to be noted, however, that the drawings illustrate only a preferred embodiment of the disclosure and is therefore not to be considered limiting of its scope as the disclosure may admit to other equally effective embodiments.

DETAILED DESCRIPTION OF THE DISCLOSURE

The methods and systems of the present disclosure will now be described more fully hereinafter with reference to the accompanying drawings in which embodiments are shown. The methods and systems of the present disclosure may be in many different forms and should not be construed as limited to die illustrated embodiments set forth herein; rather, these embodiments are provided so that this disclosure will be thorough and complete, and will fully convey its scope to those skilled in the art. Like numbers refer to like elements throughout.

Figure 1:
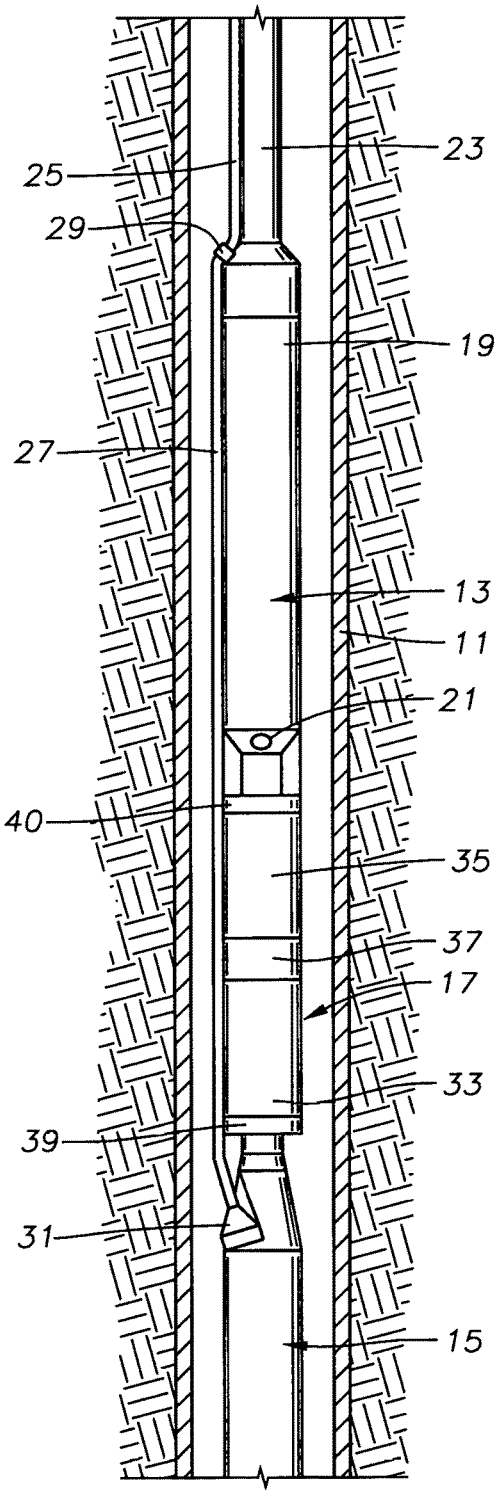
FIG. 1 is a schematic side view of a pump assembly in accordance with this disclosure.

Referring to FIG. 1, a well with casing 11 is illustrated as containing an electrical submersible pump assembly (ESP) 13. ESP 13 has a motor 15, which is normally a three phase electrical motor. Motor 15 is filled with a dielectric motor lubricant. A pressure equalizer or seal section 17 has features to equalize the internal pressure of the motor lubricant with the hydrostatic pressure of well fluid surrounding motor 15. Seal section 17 may be located above motor 15, as shown, and will be in fluid communication with the motor lubricant in motor 13. Motor 15 has a drive shaft assembly that extends through seal section 17 and drives a pump 19. Pump 19 may be a centrifugal pump having a large number of stages, each stage having an impeller and a diffuser. Alternately, pump 19 may be another type, such as a progressing cavity pump. Pump 19 has an intake 21 for drawing well fluid in.

A string of production tubing 23 extends to a wellhead (not shown) and supports ESP 13. Tubing 23 may comprise sections secured together by threads. Alternately, tubing 23 may comprise continuous coiled tubing. A power cable 25 extends downward from the wellhead and is strapped to tubing 23. A motor lead 27 connects to power cable 25 at a splice or connection 29 located above ESP 13. Motor lead 27 extends alongside ESP 13 and has a motor lead connector 31 on its lower end that plugs into a receptacle at the upper end of motor 15. Pump 19 discharges well fluid through its upper end into tubing 23 in this example. If tubing 23 is continuous coiled tubing, power cable 25 could be located inside the coiled tubing, in which case, pump 19 would discharge into the annulus in casing 11 surrounding the coiled tubing.

Motor 15, pump 19 and seal section 17 comprise modules that are brought separate from each other to a well site, then secured together by bolted flanges or threaded collars. ESP 13 may have other modules, such as a gas separator and a thrust bearing unit. Alternately, a thrust bearing unit could be formed as part of seal section 17. Also, motor 15, pump 19 and seal section 17 each could be formed in more than one module and connected in tandem.

In this example, seal section 17 has a housing shown with a lower housing or chamber 33 and an upper housing or chamber 35; however only a single chamber is feasible. The terms "upper" and "lower" and the like are used merely for convenience and not in a limiting manner. ESP 11 could be installed in inclined and horizontal sections of wells. Lower chamber 33 and upper chamber 35 are secured together by an intermediate threaded connector or guide member 37. Intermediate guide member 37 normally has external threads that secure to internal threads in lower chamber 33 and in upper chamber 35. A base or lower guide member 39 at the lower end of lower chamber 33 secures seal section 17 to a lower module, which would be motor 15 in the example of FIG. 1. A head or upper guide member 40 at the upper end of upper chamber 35 secures seal section 17 to another module, which is pump 19 in the example of FIG. 1.

Figure 2:
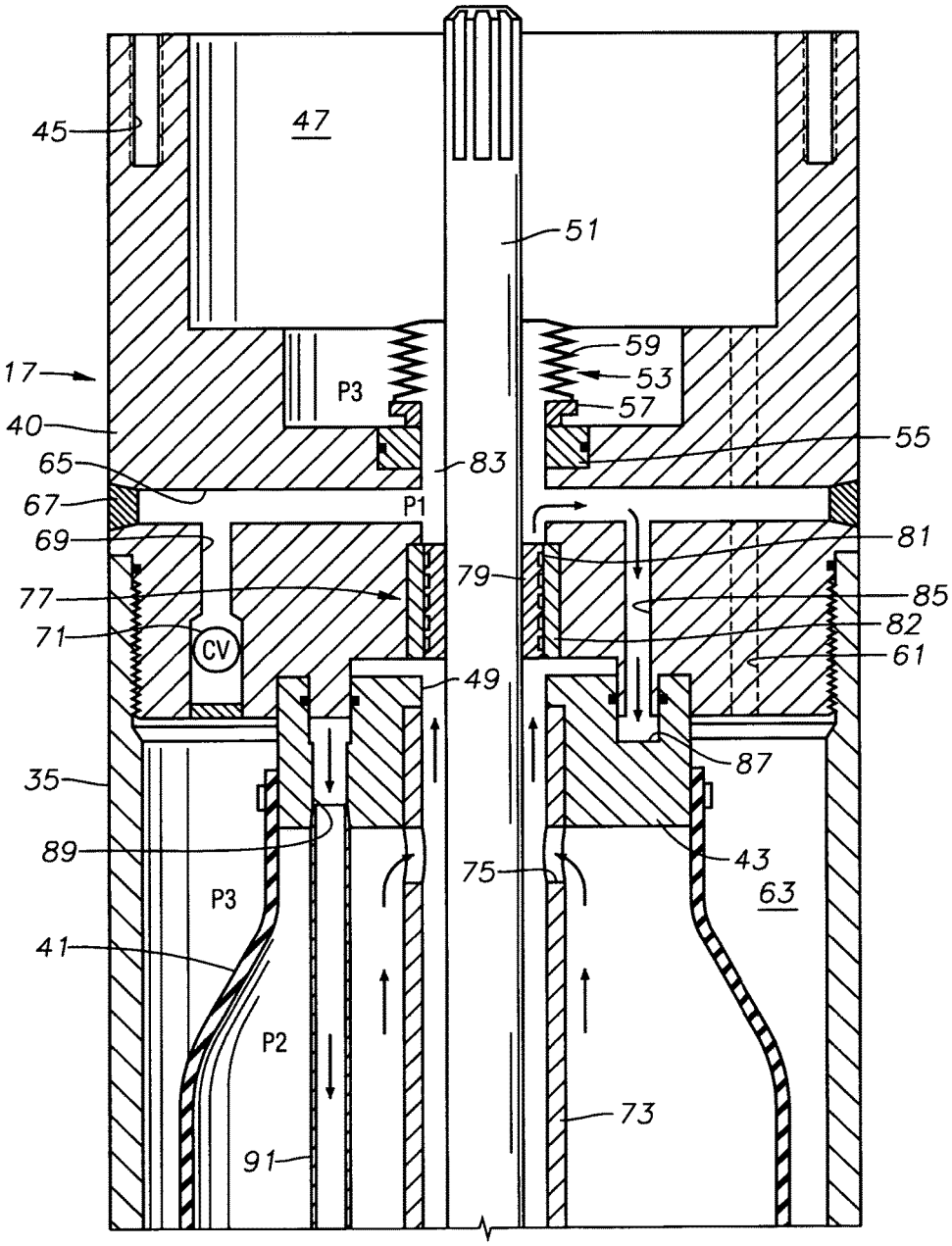
FIG. 2 is a sectional view of an upper portion of the seal section of FIG. 1, showing an upper internal lubricant pump.

Referring to FIG. 2, upper chamber 35 contains a flexible upper container or compensating element 41, which may be an elastomeric bag, as shown, a metal bellows, or other device. Upper compensating element 41 is a tubular member with a circular lower end that is sealed to the upper side of intermediate guide member 37 (FIG. 3), and a circular upper end sealed to the lower side of upper guide member 40. In this example, upper compensating element 41 seals to an upper chamber adapter 43, which in turn connects to the lower end of upper guide member 40 and may be considered to be a part of upper guide member 40.

Upper guide member 40 has threaded holt holes 45 in its upper end for connecting seal section 17 to pomp 19 (FIG. 1), or to a gas separator if one is used. Alternately, a threaded rotatable collar could be employed. Upper guide member 40 has an upper cavity 47 that will be filled with well fluid at the hydrostatic well fluid pressure in the well. A shaft passage or bore 49 extends axially through adapter 43 and upper guide member 40. Seal section drive shaft 51 extends through shaft passage 49 and has splined lower and upper ends for connecting to the drive shafts in motor 15 and pump 19 (FIG. 1).

A shaft seal 53 is located in shaft passage 49 and in cavity 47 to seal against leakage of well fluid around shaft 51 and down shaft passage 49. Shaft seal 53 is illustrated as being a conventional mechanical lace seal having a non rotating base 55 sealed to shaft passage 49. A rotating component or runner 57 couples to shaft 51 via an elastomeric boot or bellows 59 for rotation therewith. Runner 57 is biased by a spring incorporated with bellows 59 against base 55 and rotatably engages base 55. Shaft seal 53 operates best if slight leakage occurs between base 55 and runner 57 to create a liquid film between the face of runner 57 and the upper side of base 55.

A communication port 61 extends through upper guide member 40 from cavity 47 to an upper chamber exterior area 63, which is within upper chamber 35 exterior of upper compensating element 41. Communication port 61 freely communicates well fluid between cavity 47 and exterior area 63. One or more fill ports 65 (two shown) extend radially from the exterior of upper guide member 40 to shaft passage 49. Fill ports 65 are employed during filling of lubricant into the interior of upper compensating element 41, then closed with a threaded plug 67. A cheek valve passage 69 extends downward from one of the fill ports 61 to exterior area 63. A check valve 73 in check valve passage 69 will allow lubricant to be expelled from the interior of compensating element 41 into exterior area 63 if the lubricant pressure in compensating element 41 exceeds the well fluid pressure in exterior area 63 by a selected amount, such as 7 psi. An increase in internal lubricant pressure in compensating element 41 over the pressure m exterior area 63 can occur due to a temperature increase of the lubricant while lowering ESP 13 into a well and while operating the ESP.

A guide tube 73 secures to the portion of shaft passage 49 in adapter 43 and extends downward around shaft 51. A guide tube annulus between guide tube 73 and shaft 51 communicates lubricant from motor 15 (FIG. 1) through guide tube ports 75 to the interior of compensating element 41.

An internal lubricant pump 77 driven by shaft 51 mounts in shaft passage 49 within upper guide element 40. Lubricant pump 77 may be a variety of types; in this example, lubricant pump 77 is an inducer type with a sleeve 79 that is fixed to shaft 51, such as by a key, for rotation in unison. Sleeve 79 has one or more external, helical grooves or flow channels 81 that define at least one helical flight. Sleeve 79 may be located within and rotate relative to a stationary bushing 82 mounted in shaft passage 49. Lubricant pump 77 is located below shaft seal base 55, defining an annular space 83 around shaft 51 between lubricant pump 77 and shaft seal 53.

A recirculation passage 85 extends from annular space 83 via one of the fill ports 65 to the lower end of upper guide member 40. In this example, an upward-facing annular channel or gallery 87 in adapter 43 registers with the outlet of recirculation passage 85. An adapter recirculation port 89 in adapter 43 extends from gallery 87 to a labyrinth tube 91. Labyrinth tube 91 extends parallel with guide tube 73 within compensating element 41 and has an open lower end near the bottom of seal section upper chamber 35, as shown in FIG. 3.

During the operation of ESP 13, lubricant pump 77 causes a slight increase in pressure P1 of the lubricant in annular space 83 over pressure P2 within the interior of compensating element 41. The increased pressure P1 may be only about 2 psi above pressure P2, and is always less than the pressure required to open check valve 71. The pressure P1 will be communicated to the interior of bellows 59 and to fill ports 65. Compensating element 41 causes the internal lubricant pressure P2 to equalize with the well fluid pressure P3 exterior of ESP 13 (FIG. 1). Thus the output pressure P1 of lubricant pump 77 will normally be slightly higher than the well fluid pressure P3 in upper cavity 47, creating slight leakage of lubricant from the interior of compensating element 41 across the interface between seal runner 57 and seal base 55 for lubrication.

The portion of the lubricant pumped by lubricant pump 77 that does not leak past seal 53 into upper cavity 47 recirculates down recirculation passages 85, 87 and 89 to labyrinth tube 91. That lubricant portion could be slightly contaminated with well fluid because of its circulation in contact with shaft seat 53. This recirculated portion of lubricant discharges into the lower end of compensating element 41. Typically any well fluid within the recirculated portion of lubricant is heavier than the lubricant, reducing the possibility of the well fluid from migrating upward, entering guide tube ports 75, and flowing down into motor 15 (FIG. 1). Because of the designed slight leakage past shaft seal 53 into upper cavity 47, a reservoir to hold additional lubricant could be included with ESP 13, such as at the lower end of motor 15 (FIG. 1).

Figure 3:
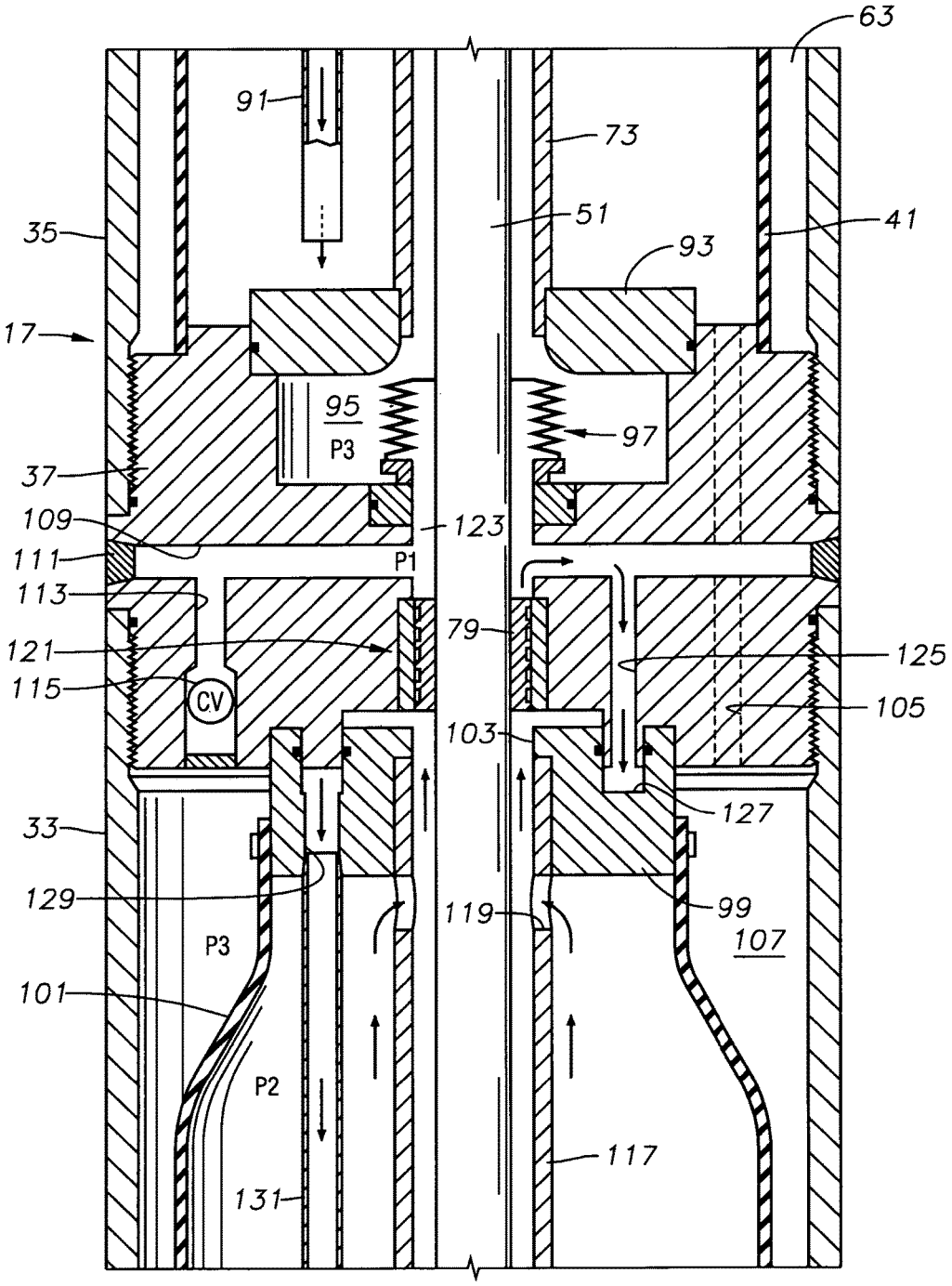
FIG. 3 is a sectional view of an intermediate portion between two chambers of the seal section of the pump assembly of FIG. 1, showing a lower internal lubricant pump.

As shown in FIG. 3, similar arrangements could be made to lower chamber 33, if one is employed. In this embodiment, a guide tube adapter 93 sealingly secures to an upper side of intermediate guide member 37. Upper chamber guide tube 73 has a lower end that secures to a central opening within guide tube adapter 93. Intermediate guide member 37 has an upper cavity 95, and guide tube adapter 93 defines an upper end of cavity 95. A shaft seal 97 that may be the same as shaft seal 53 (FIG. 2) mounts around shaft 51 within cavity 95. Cavity 95 is in fluid communication with lubricant in the annulus of upper chamber guide tube 73.

An intermediate adapter 99 secures to the lower side of intermediate guide member 37. A lower compensating element 101 has an upper end sealed to adapter 99. A shaft passage 103 extends through adapter 99 and intermediate guide member 37. A communication port 105 extends through adapter 99 and intermediate guide member 37, connecting the interior of upper compensating element 41 with a lower chamber exterior area 107, which is exterior of lower compensating element 101. One or more fill ports 109 may extend from the exterior of intermediate guide member 37 to shaft passage 103. Plugs 111 at the exterior of intermediate guide member 37 close fill ports 109 after filling seal section 17 (FIG. 1) with lubricant. A check valve passage 113 has a check valve 115 and extends from one of the fill ports 109 to lower chamber exterior area 107. Check valve 115 allows downward flow from shaft passage 103 into lower chamber exterior area 107 if the lubricant pressure in compensating element 101 exceeds a selected amount, such as 7 psi.

A guide tube 117 attaches to shaft passage 103 within adapter 99. Guide tube 117 secures to lower guide member 39 (FIG. 1) and has guide tube ports 119 near its upper end. An annulus surrounding shaft 51 within guide tube 117 communicates lubricant in motor 15 (FIG. 1) with the interior of lower compensating element 101.

A lower chamber lubricant pump 121, which may be identical to upper chamber lubricant pump 77 (FIG. 2), mounts within adapter 99 in shaft passage 103. Lubricant pump 121 and shaft seal 97 define between them an annular space 123 in shaft passage 103. A recirculation passage 125 allows lubricant flow from annular apace 123 to a lower portion of lower chamber compensating element 101. In this example, recirculation passage 125 extends downward from one of the fill ports 109 to an annular channel or gallery 127 on the upper side of adapter 99. An adapter recirculation passage 129 in adapter 99 leads from gallery 127 into a labyrinth tube 131 in lower chamber compensating element 101. Labyrinth tube 131 extends downward in lower compensating element 101 and has an open lower end (not shown) near the upper end of lower guide member 39 (FIG. 1).

Lower lubricant pump 121 is sized to produce a discharge pressure P1 less than the pressure required to open check valve 115. The pressure P1 created in annular space 123 is slightly greater than the pressure P2 in lower chamber compensating element 101. Compensating element 101 equalizes lubricant pressure P2 with the well fluid hydrostatic pressure P3. Some of the lubricant flow from lower lubricant pump 121 may leak outward past shaft seal 97 into cavity 95. Some of the lubricant flow from lower lubricant pump 121 passes through recirculation passages 125, 127 and 129 and downward through labyrinth tube 131.

Figure 4:
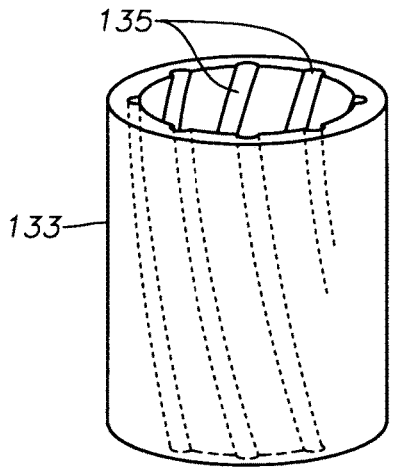
FIG. 4 is a perspective view of an alternate embodiment of the internal lubricant pumps of FIGS. 2 and 3.
Figure 5:
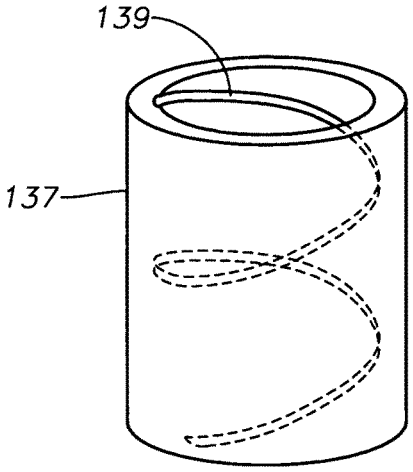
FIG. 5 is a perspective view of another alternate embodiment of the internal lubricant pumps of FIGS. 2 and 3.
Figure 6:
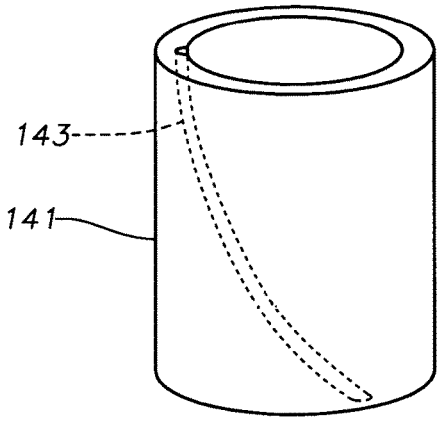
FIG. 6 is a perspective view of still another embodiment of the internal lubricant pumps of FIGS. 2 and 3.

FIGS. 4-6 illustrate alternates to lubricant pumps 77 (FIG. 2) and 121 (FIG. 3). In FIG. 4, the lubricant pump is a non rotating bushing or sleeve 133 with a plurality of internal, helical grooves or flow channels 135 formed in its interior side wall. Shaft 51 (FIG. 2) rotates inside of sleeve 133. In FIG. 5, this lubricant pump also has a non rotating sleeve 137. Sleeve 137 has a single helical groove 139 in its cylindrical interior wall. Helical groove 139 makes multiple turns from the lower to the upper end of sleeve 137. In FIG. 6, non rotating sleeve 141 has a single helical groove 143 that does not make a complete 360 degree turn from the lower to the upper end of sleeve 141.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

The invention claimed is:

1. A well pump assembly, comprising:

a well fluid pump;

a motor, a seal section between the motor and the well fluid pump and having a seal section shaft for transferring rotation of a motor drive shaft to a pump drive shaft, comprising:

a housing having at least one guide member with a shaft passage through which the seal section shaft extends, the guide member defining a chamber within the housing;

a compensating element having an upper end in sealing engagement with the guide member around the shaft passage and an interior in fluid communication with lubricant in the motor;

a seal around the shaft at the shaft passage for sealing well fluid from entry into the compensating element;

a well fluid pressure port in the seal section that applies well fluid pressure to an exterior of the compensating element;

a lubricant pump within the shaft passage below the seal, the lubricant pump being in fluid communication with the lubricant in the compensating element and driven by the seal section shaft for applying a pressure to an annular space between the lubricant pump and the seal greater than the well fluid pressure on the exterior of the compensating element;

a recirculation port extending within the guide member from the annular space to the interior of the compensating element; and a labyrinth tube secured to the recirculation port and extending within the compensating element to a lower portion of the compensating element.

2. A well pump assembly, comprising:

a well fluid pump;

a motor;

a seal section between the motor and the well fluid pump and having a seal section shaft for transferring rotation of a motor drive shaft to a pump drive shaft, comprising:

a housing having at least one guide member with a shaft passage through which the seal section shaft extends, the guide member defining a chamber within the housing;

a compensating element having an upper end in sealing engagement with the guide member around the shaft passage and an interior in fluid communication with lubricant in the motor;

a seal around the shaft at the shaft passage for sealing well fluid from entry into the compensating element;

a well fluid pressure port in the seal section that applies well fluid pressure to an exterior of the compensating element;

a lubricant pump within the shaft passage below the seal, the lubricant pump being in fluid communication with the lubricant in the compensating element and driven by the seal section shaft for applying a pressure to an annular space between the lubricant pump and the seal greater than the well fluid pressure on the exterior of the compensating element;

a vent passage extending from the annular space through the guide member to an interior of the housing on the exterior of the compensating element;

a check valve that allows venting of lubricant through the vent passage if the lubricant pressure exceeds the well fluid pressure within the housing on the exterior of the compensating element by a selected amount; and the lubricant pump has an output pressure less than the selected amount of the check valve.

3. The assembly according to claim 2, wherein the lubricant pump has a least one helical flow channel.

4. The assembly according to claim 2, wherein:

the lubricant pump comprises a sleeve that rotates with the shaft and has at least one external helical flow channel.

5. The assembly according to claim 2, wherein:

the lubricant pump comprises a non-rotating sleeve with at least one internal helical flow channel.

6. A well pump assembly, comprising:

a well fluid pump;

a motor;

a seal section between the motor and the well fluid pump and having a seal section shaft for transferring rotation of a motor drive shaft to a pump drive shaft, comprising:

a housing having at least one guide member with a shaft passage through which the seal section shaft extends, the guide member defining a chamber within the housing;

a compensating element having an upper end in sealing engagement with the guide member around the shaft passage and an interior in fluid communication with lubricant in the motor;

a seal around the shaft at the shaft passage for sealing well fluid from entry into the compensating element;

a well fluid pressure port in the seal section that applies well fluid pressure to an exterior of the compensating element;

a lubricant pump within the shaft passage below the seal, the lubricant pump being in fluid communication with the lubricant in the compensating element and driven by the seal section shaft for applying a pressure to an annular space between the lubricant pump and the seal greater than the well fluid pressure on the exterior of the compensating element;

an adapter that secures to a lower side of the guide member, the compensating element having an upper end sealed around the adapter, the adapter having an adapter bore through which the shaft extends; and a guide tube through which the shaft extends, defining a guide tube annulus, the guide tube being secured to the adapter bore and extending through the compensating element, the guide tube having a guide tube port adjacent the adapter that communicates lubricant in the interior of the compensating element with the guide tube annulus, the adapter bore and a lower end of the lubricant pump.

7. The assembly according to claim 6, further comprising:

a recirculation passage extending from an upper end of the lubricant pump downward through the guide member and adapter to a lower side of the adapter; and a labyrinth tube secured to the recirculation passage on the lower side of the adapter, the labyrinth tube extending downward within the compensating element and having an open end in a lower portion of the compensating element.

8. A well pump assembly, comprising:

a well fluid pump;

a motor;

a seal section between the motor and the well fluid pump and having a seal section shaft for transferring rotation of a motor drive shaft to a pump drive shaft, comprising:

a housing having an upper guide member with a shaft passage through which the seal section shaft extends, the upper guide member having an upper cavity on an upper end for receiving well fluid, the upper guide member and the housing defining a compensating element chamber below the upper guide member;

a flexible compensating element in the compensating element chamber, the compensating element having an upper end sealed to the guide member around the shaft passage and an interior containing motor lubricant that is in fluid communication with motor lubricant in the motor and also in fluid communication with motor lubricant in the shaft passage;

a shaft seal around the shaft for sealing well fluid in the upper cavity from entry into the shaft passage, the shaft seal having a rotating element that rotates with the shaft and slides against a stationary seal base mounted in the shaft passage;

a well fluid communication port in the guide member that leads from exterior of the guide member to a portion of the compensating chamber exterior of the compensating element;

a lubricant pump having a discharge within the shaft passage below the seal base, the lubricant pump having an intake in fluid communication with the lubricant in the shaft passage and driven by the seal section shaft; and a recirculation passage extending within the guide member from the shaft passage at a point between the discharge of the lubricant pump and the seal base to the interior of the compensating element.

9. The assembly according to claim 8, further comprising:

a labyrinth tube having an upper end coupled to an outlet of the recirculation passage and a lower end within and adjacent a lower end of the compensating element, requiring lubricant pumped by the lubricant pump to flow into a lower portion of the compensating element.

10. The assembly according to claim 8, further comprising:

a check valve passage extending through the guide member from the shaft passage at a point between the lubricant pump and the seal base to the upper cavity exterior of the compensating element;

a check valve in the check valve passage that allows lubricant from the interior of the compensating element to be expelled if lubricant pressure in the interior exceeds well fluid pressure in the upper cavity by a selected level; and wherein the lubricant pump increases a pressure of the lubricant in the shaft passage by an amount less than the selected level.

11. The assembly according to claim 8, wherein the lubricant pump has a least one helical flow channel.

12. The assembly according to claim 8, wherein the lubricant pump comprises a sleeve that rotates with the shaft and has at least one external helical flow channel.

13. The assembly according to claim 8, wherein the lubricant pump comprises a non-rotating sleeve with at least one internal helical flow channel.

* * * * *